US006649216B2

(12) United States Patent
Gust et al.

(10) Patent No.: US 6,649,216 B2
(45) Date of Patent: Nov. 18, 2003

(54) IN-LINE ULTRAVIOLET CURABLE COATING PROCESS AND PRODUCTS PRODUCED THEREBY

(75) Inventors: Steven J. Gust, Greenville, SC (US); Patrick M. Smith, Greenville, SC (US); Jan C. Westermeier, Taylors, SC (US)

(73) Assignee: Mitsubishi Polyester Film, LLC, Greer, SC (US)

( * ) Notice: Subject to any disclaimer, the term of this patent is extended or adjusted under 35 U.S.C. 154(b) by 0 days.

(21) Appl. No.: 09/946,718

(22) Filed: Sep. 5, 2001

(65) Prior Publication Data

US 2002/0110647 A1 Aug. 15, 2002

Related U.S. Application Data

(60) Provisional application No. 60/230,651, filed on Sep. 7, 2000.

(51) Int. Cl.[7] ..... B05D 3/06; B05D 5/02

(52) U.S. Cl. ..... 427/173; 427/171; 427/172; 427/393.5; 427/508; 427/558; 427/595; 427/256

(58) Field of Search ..... 427/171, 172, 427/173, 551, 558, 496, 508, 595, 596, 393.5, 256

(56) References Cited

U.S. PATENT DOCUMENTS

| | | | | |
|---|---|---|---|---|
| 4,052,521 A | | 10/1977 | Ferrari | |
| 4,822,828 A | | 4/1989 | Swofford | |
| 5,244,693 A | | 9/1993 | Inaba et al. | |
| 5,268,420 A | * | 12/1993 | Nishimura et al. | 524/857 |
| 5,350,601 A | | 9/1994 | Culbertson et al. | |
| 5,578,095 A | | 11/1996 | Bland et al. | |
| 5,700,302 A | | 12/1997 | Stoetzel et al. | |
| 5,876,792 A | | 3/1999 | Caldwell | |
| 5,975,988 A | | 11/1999 | Christianson | |
| 6,120,868 A | * | 9/2000 | Heberger et al. | 428/41.4 |
| 6,403,224 B1 | * | 6/2002 | Okajima et al. | 428/423.7 |
| 2002/0027313 A1 | | 3/2002 | Shibano et al. | 264/448 |

FOREIGN PATENT DOCUMENTS

| | | |
|---|---|---|
| DE | 4025613 A1 | 2/1991 |
| JP | 2008030 | 1/1990 |

OTHER PUBLICATIONS

International Search Report, Officer: Beck, Nov. 4, 2001.

* cited by examiner

*Primary Examiner*—Shrive P. Beck
*Assistant Examiner*—Kristen Crockford Jolley

(57) ABSTRACT

The present invention relates to a method of coating polymer film that includes the steps of extruding a cast sheet; stretching the sheet in a machine direction; applying a UV-curable coating to the sheet in-line; stretching the sheet in a transverse direction in a tenter; and exposing the coated sheet to UV radiation in-line.

18 Claims, No Drawings

IN-LINE ULTRAVIOLET CURABLE COATING PROCESS AND PRODUCTS PRODUCED THEREBY

BACKGROUND OF THE INVENTION

1. Field of the Invention

The present invention relates generally to a method of coating and curing UV-curable coatings in-line on polymer film, and the film produced thereby. More particularly, the present invention is directed to a commercially viable process for producing a coated polymer film having various beneficial properties through in-line coating and UV curing steps.

2. Description of Related Art

Polymer film can be modified in various ways to enhance its usefulness for specific applications. Coatings applied to one or both surfaces of the film are commonly used to achieve such modification. Various qualities such as adhesion, smoothness, oxygen permeability, printability, opacity, scratch resistance and the like can be altered through the judicious use of coating technology. Among such coatings, UV curable coatings are known. These coatings can be cured by the application of ultraviolet radiation to the coating. Known UV curable coatings are applied to film off-line, after the film has been oriented, set and cooled.

BRIEF SUMMARY OF THE INVENTION

Accordingly, it is an object of the present invention to a provide for the in-line application of UV curable coatings.

It is a further object of the present invention to provide an economical and efficient method for coating film with UV curable coatings.

It is another object of the present invention to provide a UV curable coating that provides a texturing treatment to a film surface.

It is a further object of the present invention to provide a UV curable binder or carrier for particulate matter suitable for application to the surface of film.

The present invention has accomplished these objectives by providing in a preferred embodiment a method of coating polymer film that includes the steps of extruding a cast sheet; stretching the sheet in a machine direction; applying a UV-curable coating to the sheet; stretching the sheet in a transverse direction in a tenter; and exposing the coated sheet to UV radiation.

DETAILED DESCRIPTION OF THE INVENTION

The present invention encompasses a method of creating UV cured coatings in-line in a biaxially oriented film production process. As discussed above, known methods of UV curing are limited to off-line application and curing of the coating. It has traditionally been considered not feasible to coat and cure UV-curable coatings in-line as part of the film manufacturing process.

Nonetheless, the present inventors have conducted an investigation into the possibility of such in-line coating and curing. While initially determining that it would be preferred to coat and cure the UV curable coating prior to the transverse direction stretch (in part because of the reduced width of the treatment area), such curing was found to result in a powdery, cracked coating that is unacceptable for many uses.

The inventors have discovered that when UV curing occurs in the neutral zone at the end of the stretch zone (or its equivalent), it prevents cracking of the cured coating in the transverse direction stretch and also allows curing before the photo-initiators can be driven off by the hot crystallizer zone temperatures. This allows films to be formed that have the properties of many known off-line UV cured films. However, this method eliminates the costly, labor-intensive off-line coating step. In addition, by applying and curing the UV curable coatings in-line, it is possible to create thinner coatings that can perform equivalently well to thicker, off-line coated UV curable coatings. UV cured products are typically expensive, so the reduction in the coating thickness can result in substantial cost savings. Moreover, when both coating application and curing occur after forward draw, the risk of cast sheet coatings coming off on and contaminating the rolls is eliminated. Furthermore, by coating the forward drawn sheet prior to the transverse direction stretch, a narrower area is coated. By such a method, it is possible to generate a coated width of approximately four times the width of the treated cast sheet, once the coated sheet is stretched approximately four times in the transverse direction. This contrasts with off-line coating, which requires coating equipment having the full width of the finished film.

The neutral zone effectively isolates the TD stretching step from the crystallizing step. The feasibility of UV curing in the neutral zone has been demonstrated by coating samples after the forward draw. Tentering then occurs, preferably with the crystallizer zones turned off or to a lower heat setting. This prevents the photoinitiator from being lost through evaporation in the hot crystallizer zones, allowing those samples to be captured and UV cured. Samples prepared via this method have shown good steel wool scratch resistance. Alternatively, coating could occur prior to forward draw (although it would be more difficult to keep coatings on the film without attrition via this method, and roll contamination is more likely).

Furthermore, higher temperature initiators which are expected to be available could be used which would not be driven off in the crystallizer zones. This would permit the use of post-tenter UV curing, in addition to neutral zone curing. In addition, electron beam curing can be used to minimize or eliminate photoinitiators. This electron beam curing could also take place in the neutral zone or post-tenter. Combinations of UV curing and electron beam curing can also be used. However, UV curing is preferred for use in many of the uses of the present invention. For example, e-beam curing typically generates x-rays. As a consequence, increased monitoring, regulatory involvement and other protective measures are required. In addition, such x-rays may have an effect on the finished film. Furthermore, e-beam curing is substantially more capital intensive than UV curing. UV curing also typically runs hotter than e-beam treatment. This can have a beneficial effect on the finished film, including its heat-set properties. However, for many applications, e-beam curing is viable. Most UV curable materials can be cured by e-beam, but no photoinitiators are needed. However, as discussed above, e-beam equipment is substantially more costly than UV curing equipment.

No significant subsequent heat cure occurs in the neutral zone. The UV unit generates only a few additional degrees of heat. Typical temperatures of about 90 to about 140, alternatively about 100 to about 110 degrees Celsius, are employed during the second stretch. Supplemental cooling equipment such as a conventional cool air supply with supply and return lines are optionally used to control the UV unit and/or film temperatures. IR blocking glass may also be used alone or with such cooling equipment to reduce heating of the PET film.

One preferred application of the present invention is for use in forming scratch-resistant lamination films. Many other UV-curable coating systems are commercially available. Of these, emulsion-type or 100% solids type coatings are preferred for use in the present invention. Various UV-curable coatings are set forth in commonly owned U.S. Pat. No. 4,822,828 to Swofford, the disclosure of which is incorporated herein by reference. A preferred hard coat coating is commercially available as Gafgard 300 from ISP.

UV curable coatings can be used to create a substantially clear, scratch-free film. While off-line coatings (including UV curable coatings) are typically applied very thickly to achieve reasonable scratch-resistance, the in-line coated UV curable coatings of the present invention have been found to provide excellent scratch-resistance at much reduced coating thicknesses. Following the machine direction stretching of a film, a UV curable coating is applied that is thick enough to fill minor imperfections created during prior processing (typically referred to as scuffs and scratches). The coating is preferably molten in both the preheating and stretching processes. It is then cured to form a layer on the surface of the film that is smooth and essentially free from physical imperfections. The final hardened coating optimally will be of similar refractive index as the film substrate so that the film surface imperfections are completely hidden. The coating can contain fillers or itself have properties to enhance handling, post-processing scratch resistance or other attributes. This development permits the production of unfilled and/or ultra-clear products using standardized processing equipment. It also permits the formation of clear films without the use of coextrusion equipment.

UV curable coatings of the present invention can be used to provide a variety of attributes to the base film. For example, the UV curable coatings can be used to form hard coats, having clear, satin and/or matte finishes, coatings with affinity to pressure sensitive adhesive, silicone release films, barrier coatings and ink jet coatings.

UV curable coatings of the present invention can also be used to texture film as a substitute for or adjunct to filler particles. Textured film surfaces can be used to enhance adhesion, printability and other properties of the film. Typically this is achieved by the addition of particles to the film or to surface layers of the film. The particles provide contouring to the film surface. UV curable coatings of the present invention can also provide such desirable texturing. Preferably, UV curable powders are used. These UV curable powders can be dispersed in the liquid coating, optimally in small concentrations. The powder particles have a predefined size range or profile based on the texturing desired.

The powder-containing coating is applied to the film surface (or surfaces) and dries, preferably in the preheat zone of the in-line film formation process. The particles optimally should have a high enough $T_g$, melt viscosity, or surface energy to remain on the surface of the film as protrusions, yet still be flowing enough to maintain intimate contact with the polymer film surface. Preferred powders for use in the present invention include those used in the automotive industry for clear coat finishes. Other preferred powders include cryogenically formed powders having shells of partially cross-linked polymers, and powder microspheres such as those used in electrostatic spray coating. Typically such applications are made in a closed system. When encapsulation technology is used, it can eliminate the hazards of handling potentially dangerous monomers and/or oligomers. Depending on the $T_g$ of the particles, they can melt and form a contiguous film coating. The known alternatives to such encapsulated particles are typically highly viscous, and must be diluted with substantial volumes of potentially hazardous diluents (typically reactive monomers). Accordingly, any system that can avoid such diluents is beneficial.

Once on the film, the particles are cured to form a bond between the particle and the film. Curing also hardens the particles. The resulting polymer film surface has a texture that is created by UV-cured "nodules" distributed over the surface. The coating can simply be a carrier for the particle dispersion, or it can be any functional coating whose final thickness will be less than the height of the nodules.

This powder-based method can also be used to form scratch-resistant coatings with lower operator exposure to UV curable coatings. By using UV curable powders, which preferably are applied from a water slurry or electrostatically, the particles can then be melted prior to or during curing to form a coating layer structure. This method greatly reduces potentially hazardous operator exposure to UV curable chemicals.

This use of the methods of the present invention is beneficial in part because the amount of UV curable material will be very small, thereby reducing cost and increasing potential reclaimability as compared to a complete coverage UV curable coating. In addition, the resulting haze contribution of this coating application should be minimal in comparison to particulate fillers. Moreover, no polymer type change is required to modify the surface for various end use requirements. The size and thermal response of the particles used in the coating can be changed to modify the surface texture and slip properties.

As mentioned above, UV curable coatings can act as a carrier for filler particles. In this way, as well, the UV curable coatings of the present invention can function as a replacement for or supplement to coextruded film layers. For example, UV curable coatings are particularly good carriers and bonding agents for "filler" systems that are used to achieve slip and abrasion resistance. Such particles (e.g., silicon dioxide) typically bond poorly to PET. When they are carried in a UV curable coating, however, greatly increased bonding between the filler particles and the carrier material is possible. This carrier system is particularly valuable for use with spherical silicas to improve their adhesion to PET.

Furthermore, the use of UV curable coatings as carriers can greatly reduce or eliminate voiding around the filler particles. If the UV cure occurs after the stretching process the voids are eliminated due to the flowability of the curing particles. Furthermore, the reduction or elimination of voids will reduce haze in the resulting film. A better particle bond is also achieved. This stronger bond also acts to improve barrier properties.

More uniform and predictable protrusion height of the fillers can be achieved if the filler is larger than the coating thickness. This more uniform protrusion height results in harder slit rolls with fewer machine direction creases. It also is beneficial in the production of films requiring controlled uniform protrusions, such as video films. Among other benefits, protrusions generally aid in minimizing scratching or scuffing. In addition, the ability to eliminate filler particles that do not add significant protrusions (and would consequently be buried in a polymer or carrier layer) can also minimize total film haze. For this purpose, filler particles of about 0.5 to about 10 microns are preferred. Preferably, the concentration is increased as particle size is reduced. A size of approximately 0.5 microns or higher is viable for this use to achieve contact between layers (e.g. to prevent sticking). This is roughly the size of the air layer that typically exists between adjacent layers in a film roll.

Two primary types of UV curable coatings can be used in the present invention. Cationic UV curable coatings typically take about a day to cure at slightly elevated temperatures, but this can be accelerated by means of methods known in the art. For example, high temperatures can be used to accelerate cure time. Alternatively, free radical UV curable coatings can be used. These typically cure essentially immediately upon contact with UV radiation. With such coatings, curing pre-tenter can also be achieved. This avoids or minimizes any bowing created by the tentering of uncured or partially cured coatings. In addition, the coating will not be marred by rollers if it is already cured between the casting roller and the machine direction stretch. However, for coating such as some scratch-resistant coatings, that must stretch freely, such an early curing option is not preferred.

While very thin coatings of less than 0.2 microns, or less than 0.1 microns can be achieved by the present method, thicker coatings are also possible where additional properties are achieved with such increased thickness. For example, hard coats requiring tightly bound chemistry can be achieved through a thicker application of the UV curable coatings of the present invention. These thicker coatings enable the formation of a tightly cross-linked system that is crucial to formation of a hard coat film. The resulting film has optimal haze and scratch-resistance properties.

UV curing is preferably performed at about 5 to about 200 ft/minute line speed, alternatively at about 10 to about 100 ft/minute, and at energies of about 100 to about 400 watts/inch, alternatively about 150 to about 300 watts/inch.

For the preferred embodiment in which coating occurs during orientation and UV curing occurs after the crystallizer zone of the tenter, heat resistant photoinitiators are used. Such photoinitiators must be able to survive the crystallizer zone temperatures, e.g., about 200 to about 300 degrees Celsius, sufficiently to act as photoinitiator for a post-tenter UV cure.

Polymer Film

For the preferred films and methods of the present invention, a polymer film substrate is most useful. It provides a lightweight, substantially transparent, inexpensive, inert, disposable or recyclable substrate that accommodates many of the end uses of safety films. In addition, the coated polymer film can also easily be laminated by heat bonding or by adhesives to various other substrates, including glass or polymeric plates marketed as glass substitutes.

The films and methods of the present invention can employ any polymeric film capable of biaxial orientation. For example, the present invention is applicable to polymeric films such as those made from polyamides exemplified by nylon; polyolefins such as polypropylene and polyethylene; polyester such as polyethylene terephthalate; polyacetal; polycarbonate; and the like. The invention is particularly applicable to polyester, most preferably polyethylene terephthalate, polyethylene naphthalate or polybutylene terephthalate. The present invention is also applicable to polymeric films including copolyesters such as polyethylene terephthalate isophthalate. A preferred process for forming a base film is set forth in U.S. Pat. No. 5,350,601 to Culbertson et al., incorporated herein by reference. Generally, any polyester film based on a polymer resulting from polycondensation of a glycol or diol with a dicarboxylic acid (or its ester equivalents) such as terephthalic acid, isophthalic acid, sebacic acid, malonic, adipic, azelaic, glutaric, suberic, succinic acids and the like, or mixtures of two or more of the foregoing, are preferred for use in the present invention. Suitable glycols include ethylene glycol, diethylene glycol, polyethylene glycol, and polyols such as propanediol, butanediol and the like. Mixtures of two or more of the foregoing are also suitable.

Any of the above base polymer films can contain conventional additives such as antioxidants, delusterants, pigments, fillers such as silica, calcium carbonate, kaolin, titanium dioxide, antistatic agents and the like, or mixtures thereof, all of which are well known in the art. Conventional coatings can be used with the films of the present invention, whether under, over, or on the opposite face of the UV curable coatings of the present invention. Combinations of the foregoing can also be employed. For example, coatings containing pigments or dyes, other colorants, stabilizers, antistatic agents, adhesion promoters and the like can be coated onto the films of the present invention. Alternatively, these additives can be incorporated into the UV curable coatings of the present invention.

In addition, for certain end uses, the base polymer film may be a coextruded polyester composite. Any of the various methods for film coextrusion of orientable polymers may be employed to produce the coextruded base films.

The films may be produced and oriented by any of the many known techniques in the art. For example, polyester is typically melted and extruded as an amorphous sheet onto a polished revolving casting drum to form a cast sheet of the polymer. The sheet is quickly cooled and then stretch oriented in one and then the other direction to impart strength and toughness to the film. The sheet is typically stretched from about two to about four times the original cast sheet dimension, in one or both directions. Generally, stretching occurs in a temperature range from about the second order transition temperature of the polymer to below the temperature at which the polymer softens and melts. Where necessary, the film is heat treated after stretching to "lock-in" the properties by further crystallizing the film. The crystallization imparts stability and good tensile properties to the film. Such heat treatment for polyester film is generally conducted at about 190° C. to about 240° C.

The films and methods of forming such films of the present invention are not limited to use as described in the preferred embodiments. The films may be employed in the production of laminates. Alternate composites in which films of the present invention may be desirable include composites with such materials as metals, polymeric articles and the like. Furthermore, it is envisioned that polymer films of the present invention can also be applied to other surfaces, including irregular surfaces, to provide unique attributes to those surfaces. The film may be heat bonded, coextruded with or adhered to the surface, or can be mechanically attached via fasteners, clips and the like.

While surface modification of the base polymer film is not required, such modification can be used with the base polymer films according to the present invention. Conventional surface modification techniques include corona treatment, which is the most common and most preferred procedure for modifying the surface of the polymer base film. Corona treatment can be used to enhance adhesion and reduce blocking of unfilled film during winding, among other things. Corona treatment of about 1.0 watt per square foot per minute is typically sufficient to achieve the desired results.

EXAMPLE 1

A scratch-resistant coating was formed according to the present invention. Polyethylene terephthalate film was biaxially oriented according to conventional methods. However, crystallizer zone temperatures were set very low (approximately 65 degrees Celsius) so samples could be captured to cure after the tenter in a lab UV unit. This simulates curing in the neutral zone. Each film was coated after machine direction orientation with the following:

Sample 1

30% by weight UCB RX01368 (an aqueous dispersion of an acrylated epoxy available from UCB Chemicals, Smyrna, Ga.; this product has a viscosity of 1760 cP @ 25 degrees C., a weight of 9.2 lb/gallon and appears as a light colored, opaque dispersion)

0.9% by weight Darocur 1173 (liquid photoinitiator available from Ciba Specialty Chemicals—2-hydroxy-2-methyl-1-phenyl-propan-1-one(HMPP), $C_{10}H_{12}O_2$)

5% by weight Nalco 2329 (75 nm colloidal silica available from Nalco Chemical Co., Naperville, Ill.)

Sample 2

30% by weight UCB RX01368

0.9% by weight Darocur 1173

10% by weight Nalco 2329

Sample 3

30% by weight UCB RX01368

3% by weight Darocur 1173

5% by weight Nalco 2329

Sample 4

30% by weight UCB RX01368

3% by weight Darocur 1173

10% by weight Nalco 2329

Sample 5

30% by weight UCB RX01368

3% by weight Darocur 1173

5% by weight Nalco 2329

5% by weight Nalco 1060 silica (60 nm colloidal silica)

The coated samples were first cured in a UV unit. The film was passed through a RPC Equipment Co. Model QC 1202 processor at 25 ft./minute using two 200 watt/inch H type UV lamps. The resulting film was then rubbed with even pressure ten times using a 4-aught (or #0000) steel wool pad to test for scratch resistance. The results were:

| Sample | Total Haze | Scratch Resistance |
|---|---|---|
| 1 | 6.5 | 4 |
| 2 | 52.0 | 3.5 |
| 3 | 11.7 | 3.5 |
| 4 | 51.5 | 2.5 |
| 5 | 59.4 | 1 |
| Uncoated Control | 1.0 | 5 |

Scratch resistance was measured on the following scale: 0 = no visible scratching; 5 = bad scratching All coated samples showed an improvement in scratch resistance over the uncoated control.

EXAMPLE 2

A scratch-resistant coating was formed according to the present invention. Polyethylene terephthalate film was biaxially oriented according to conventional methods. The following samples were coated after the machine direction stretch and before the Transverse direction stretch.

Sample 1

Northwest Coatings Exp. 17825A.

Sample 2

Northwest Coatings Exp. 17825B

Sample 3

Northwest Coatings Exp. 17825C

Coatings for samples 1, 2, and 3, were provided by Northwest Coatings, Oak Creek, Wis. The coatings contained variations of polymeric photoinitiators which were designed to allow curing after the heat setting zone.

Sample 4

Actinic Act 200

This coating was provided by Actinic, Inc., Greensboro, N.C.

The coating is a commercially available coating which contains a standard non-polymeric photoinitiator.

After coating, the samples were subjected to heating, TD stretching, Heat Setting in the Crystallizer zone at around 230 deg C., cooling, and finally UV cured after the tenter with a fusion Aetek UV unit at 300 watts/inch with a H type bulb at a line speed of 68 ft/min.

The resulting film was then rubbed with even pressure ten times using a 4-aught (or #0000) steel wool pad to test for scratch resistance. The results were:

| Sample | Total Haze | Scratch Resistance |
|---|---|---|
| 1 | 43.5% | 0.5 |
| 2 | 13.2% | 0.3 |
| 3 | 28.3% | 0.1 |
| 4 | 18.0% | 4.0 |
| Uncoated Control | 1.0% | 5.0 |

Scratch resistance was measured on the following scale: 0 = no visible scratching; 5 = bad scratching All coated samples showed an improvement in scratch resistance over the uncoated control. This Example shows that it is possible to develop coatings with photoinitiators that can withstand the high temperatures that are encountered in the film heat setting step.

The present invention having been thus described with particular reference to the preferred forms and embodiments thereof, it will be obvious to one of ordinary skill in the art that various changes and modifications may be made therein without departing from the spirit and scope of the invention as defined in the appended claims.

What is claimed is:

1. A method of coating polymer film that comprises the steps of:

extruding a cast sheet;

stretching said sheet in a machine direction;

applying a UV-curable coating to said sheet in-line;

stretching said sheet in a transverse direction in a tenter;

passing said sheet through a crystallizer zone;

exposing said coated sheet to UV radiation in-line after said crystallizer zone, wherein said coating includes a photoinitiator and is applied prior to said crystallizer zone, and wherein said photoinitiator is sufficiently heat resistant to survive a crystallizer zone temperature of about 200 to about 300 degrees Celsius in photoinitiating effective amounts.

2. The method of claim 1, wherein said coating is applied to said sheet prior to any stretching step.

3. The method of claim 1, wherein said coating is applied to said sheet between said stretching steps.

4. The method of claim 1, wherein said coating is applied to said sheet after said stretching steps in said tenter.

5. The method of claim 1, wherein said coating has a refractive index substantially the same as a refractive index of said sheet.

6. The method of claim 1, wherein said coating includes UV curable powders.

7. The method of claim 6, wherein said UV curable powders have sufficient $T_g$, melt viscosity or surface energy to remain as protrusions on said sheet after curing.

8. The method of claim 1, wherein said coating further includes filler particles.

9. The method of claim 8, wherein said film is substantially free of voids adjacent said filler particles.

10. The method of claim 1, wherein said coating is cationic.

11. The method of claim 1, wherein said coating is a free radical coating.

12. The method of claim 1, wherein said film comprises polyester.

13. The method of claim 1, wherein said UV radiation is applied at about 150 to about 350 watts/inch.

14. The method of claim 1, wherein said photoinitiator is polymeric.

15. A method of forming a textured film surface, comprising the steps of:

forming a biaxially oriented film coated in-line with a UV curable coating, wherein said UV curable coating contains UV curable particles;

exposing said coating to UV radiation sufficient to cause said particles to adhere to said film, yet extend from said coating as protrusions.

16. The method of claim 15, wherein said coating includes filler particles that form protrusions.

17. The method of claim 16, wherein said filler particles are larger than a thickness of said coating.

18. The method of claim 15, wherein said UV curable particles are larger than a thickness of said coating.

* * * * *